US006213547B1

(12) United States Patent
Bowe et al.

(10) Patent No.: US 6,213,547 B1
(45) Date of Patent: Apr. 10, 2001

(54) ADJUSTABLE BABY BOTTLE HOLDER

(76) Inventors: Randall H. Bowe; Shalann D. Bowe, both of 36 N. Spring Blvd., Tarpon Springs, FL (US) 34689

( * ) Notice: Subject to any disclaimer, the term of this patent is extended or adjusted under 35 U.S.C. 154(b) by 0 days.

(21) Appl. No.: 09/332,693

(22) Filed: Jun. 14, 1999

(51) Int. Cl.[7] ..... A47C 7/62

(52) U.S. Cl. ..... 297/188.01; 248/102; 248/103; 297/183.3

(58) Field of Search ..... 297/183.3, 183.2, 297/183.4, 188.01, 463.2; 224/409; 248/102, 103

(56) References Cited

U.S. PATENT DOCUMENTS 1,136,529 * 4/1915 Hopwood ..... 248/102
1,220,266 * 3/1917 Ott ..... 248/103
1,281,948 * 10/1918 Guiterman ..... 248/102
1,501,080 * 7/1924 Wickham ..... 248/102
1,826,810 * 10/1931 Morishita ..... 248/102
1,863,163 * 6/1932 Malti et al. ..... 248/102
2,050,841 * 8/1936 Houghton ..... 248/102

* cited by examiner

*Primary Examiner*—Peter M. Cuomo
*Assistant Examiner*—Stephen Vu

(57) ABSTRACT

A baby bottle holding system including a baby bottle support for removably receiving a baby bottle in a position in proximity to a child for drinking. An upper member is located above the baby bottle support allowing a child to drink from the supported baby bottle. The upper member has adjustment components under the control of a child care provider. The adjustment components function to position the upper member in a predetermined position as a function of the size and position of the child. An intermediate adjustment assembly between the baby bottle support and the upper member are under the control of the child and the child care provider to vary the position of the baby bottle with respect to the upper member.

7 Claims, 3 Drawing Sheets

ADJUSTABLE BABY BOTTLE HOLDER

BACKGROUND OF THE INVENTION

1. Field of the Invention

The present invention relates to an adjustable baby bottle holder and more particularly pertains to supporting a baby bottle in any of a variety of orientations to allow a child to easily feed himself or herself 2. Description of the Prior Art The use of holders for baby bottles and other objects of known designs and configurations is known in the prior art. More specifically, holders for baby bottles and other objects of known designs and configurations heretofore devised and utilized for the purpose of conveniencing children and child care providers by known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 1,826,810 to Morishita discloses a nursing bottle holder. U.S. Pat. No. 1,863,163 to S. Malti et al discloses a bottle support. U.S. Pat. No. 2,362,020 to L. Morrow discloses a nursing bottle holder. U.S. Pat. No. 2,514,134 to R. L. Mann discloses a support to hold infant's milK bottles. U.S. Pat. No. 2,628,802 to A. O. Wahlberg discloses a holder for nursing bottles. U.S. Pat. No. 3,298,649 to M. R. Paglee discloses a nursing bottle holder. U.S. Pat. No. 4,121,797 to MacNeil discloses a children's bottle and toy holder. U.S. Pat. No. 4,315,654 to Crook discloses a baby bottle feeder. U.S. Pat. No. 4,951,997 to Kenney discloses an infant feeding chair. U.S. Pat. No. 4,989,811 to Millis et al discloses an attachable baby bottle holder with an attaching mechanism. Lastly, U.S. Pat. No. 5,613,657 to Olaiz discloses a baby bottle keeper.

While these devices fulfill their respective, particular objectives and requirements, the aforementioned patents do not describe a baby bottle holding system that allows supporting a baby bottle in any of a variety of orientations to allow a child to feed himself or herself, easily, conveniently, sanitarily and safely.

More specifically, small children today are spending increased amounts of time strapped in commercially available infant carriers. Such carriers with a child may be positioned on a table or counter, may be separably supported onto a base for retention on a vehicle seat, may be carrier by a child care provider or the like. While the child is in its carrier, it is very common for the child to be drinking from a baby bottle. When the child is too young, with underdeveloped motor skills, or an insufficient attention span, there is a need for the child care provider to hold the bottle during feeding or to periodically position the baby bottle adjacent to the baby's mouth after spitting it out in an effort to allow self feeding. Some assistance may be provided by a pillow functioning as a support when the hands of the child are of limited benefit as a bottle holder. No existing method or apparatus is known for the convenient deployment for a child in an infant carrier to assist in feeding. No existing method or apparatus, such as a pillow prop, or the like, easily retains the baby bottle in position for feeding the child regardless of the child's attention span or motor skills. No existing method or apparatus promotes sanitation of the baby bottle nipple by precluding it from dropping onto a floor or like surface which might soil the nipple with attendant problems to the child and care provider. No existing method or apparatus allows the child or care provider to maintain attention to an alternate task, such as safely driving a car, without periodic retrieval of a baby bottle dropped by a feeding child.

In this respect, the baby bottle holding system according to the present invention substantially departs from the conventional concepts and designs of the prior art, and in doing so provides an apparatus primarily developed for the purpose of supporting a baby bottle from an infant carrier handle in any of a variety of orientations to allow a child to easily feed himself or herself with significant benefits to the child and child care provider.

Therefore, it can be appreciated that there exists a continuing need for a new and improved baby bottle holding system which can be used for supporting a baby bottle from above and in any of a variety of orientations to allow a child of a wide variety of sizes to easily feed himself or herself with minimum assistance from a child care provider. In this regard, the present invention substantially fulfills this need.

SUMMARY OF THE INVENTION

In view of the foregoing disadvantages inherent in the known types of holders for baby bottles and other objects of known designs and configurations now present in the prior art, the present invention provides an improved baby bottle holding system. As such, the general purpose of the present invention, which will be described subsequently in greater detail, is to provide a new and improved baby bottle holding system and method which allows a child to easily feed himself or herself.

To attain this, the present invention essentially comprises a new and improved infant carrier system with adjustable baby bottle holder comprising, in combination an infant carrier having an upper surface for supporting a child and a lower surface for positioning on a recipient surface and with lateral sides. The carrier has an inverted U-shaped handle. The handle has opposed lateral legs and free lower ends pivotally secured to the sides of the infant carrier. The handle has a generally horizontal intermediate leg coupling the lateral legs remote from their lower ends. The free ends are joined to the sides of the carrier with mechanisms to position the handle at any of a plurality of preselected angles. Next provided is a support ring. The support ring has a central axis. The ring is of a size to receive and support a baby bottle. Lateral disposed apertures are provided in the ring. A threaded aperture is provided through an enlarged lower region. A threaded bolt is provided in the aperture. The bolt has an abutment surface on its inner end adapted to contact and secure the baby bottle. The bolt is provided with a head at its outer end to allow rotation of the bolt for securing and releasing the baby bottle within the ring. Next provided is a downwardly facing semicircular saddle. The saddle is formed with lower free ends. The lower free ends are provided with apertures aligned with the apertures of the support ring. Rivets are also provided and extend through the aligned apertures of the saddle and ring to allow the rotation of the ring with respect to the saddle about an essentially horizontal axis. The saddle also has an uppermost extent located centrally between the free ends. Next provided is a horizontally oriented rigid rod. The rod has vertically oriented loops formed at each end. A generally vertical strap with a pile type fastener at each end is secured to an upper extent of each loop. The strap is removably positioned around the ends of the intermediate leg of a handle. A generally horizontal strap with a pile type fastener is provided at each end and is secured to a lateral extent of each loop. The horizontal strap is removably positioned around the upper extents of the lateral legs of the handle. The straps are adapted to position the rod at a preselected elevation with respect to the upper surface of the infant carrier. A block is next provided. The block has a C-shaped horizontal recess along its upper extent for being removably coupled with, and rotatable with respect to, the rod. The block has a lowermost extent coupled to the uppermost extent of the saddle. Lastly provided is a baby bottle. The baby bottle has a first axis over the majority of its extent removably positioned within the ring and axially coextensive with the axis of the ring. The baby bottle has a second axis over the minority of its extent terminating in a nipple with a nipple ring. The end of the baby bottle remote from the nipple is adapted to rotate and contact the saddle for functioning to limit the angular movement of the baby bottle and support ring within the saddle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved baby bottle holding system which has all of the advantages of the prior art holders for baby bottles and other objects of known designs and configurations and none of the disadvantages.

It is another object of the present invention to provide a new and improved baby bottle holding system which may be easily and efficiently manufactured and marketed.

It is further object of the present invention to provide a new and improved baby bottle holding system which is of durable and reliable constructions.

An even further object of the present invention is to provide a new and improved baby bottle holding system which is susceptible of a low cost of manufacture with regard to both materials and labor, and which accordingly is then susceptible of low prices of sale to the consuming public, thereby making such baby bottle holding system economically available to the buying public.

Lastly, it is an object of the present invention to provide a new and improved baby bottle holding system including a baby bottle support for removably receiving a baby bottle in a position in proximity to a child for drinking. An upper member is located above the baby bottle support allowing a child to drink from the supported baby bottle. The upper member has adjustment components under the control of a child care provider. The adjustment components function to position the upper member in a predetermined position as a function of the size and position of the child. An intermediate adjustment assembly between the baby bottle support and the upper member are under the control of the child and the child care provider to vary the position of the baby bottle with respect to the upper member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
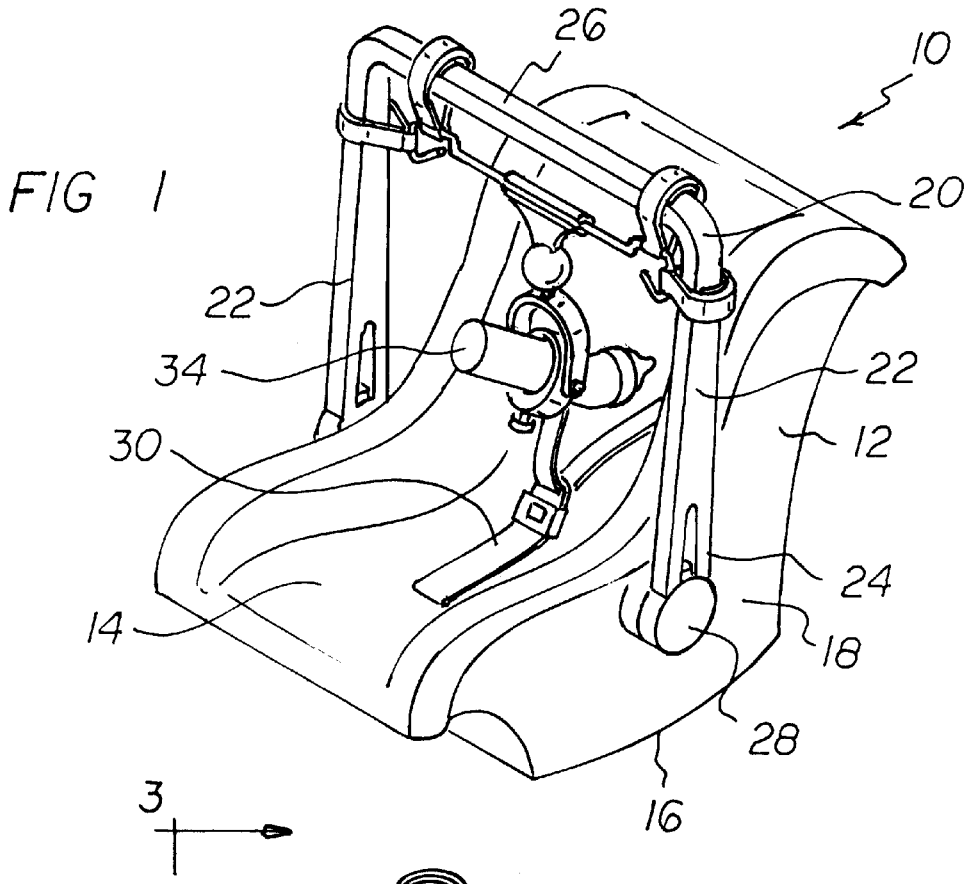
FIG. 1 is a perspective illustration of the baby bottle holding system constructed in accordance with the principles of the present invention.
Figure 2:
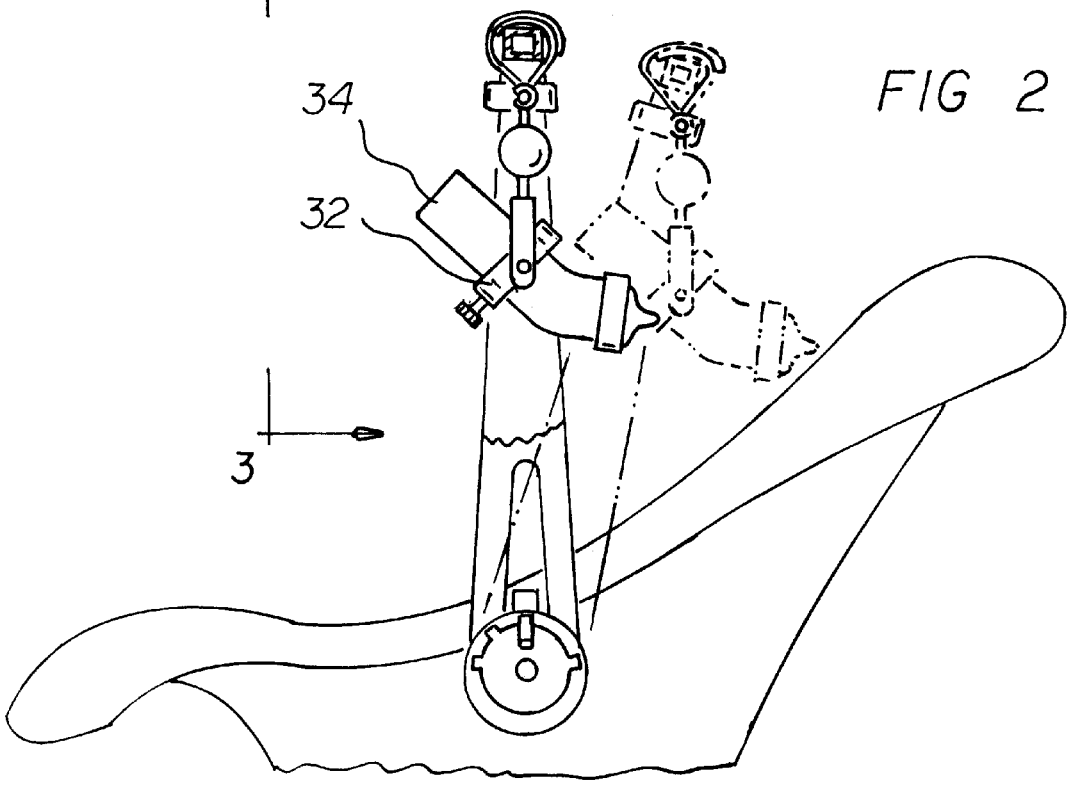
FIG. 2 is a side elevational view of the system as shown in FIG. 1.
Figure 3:
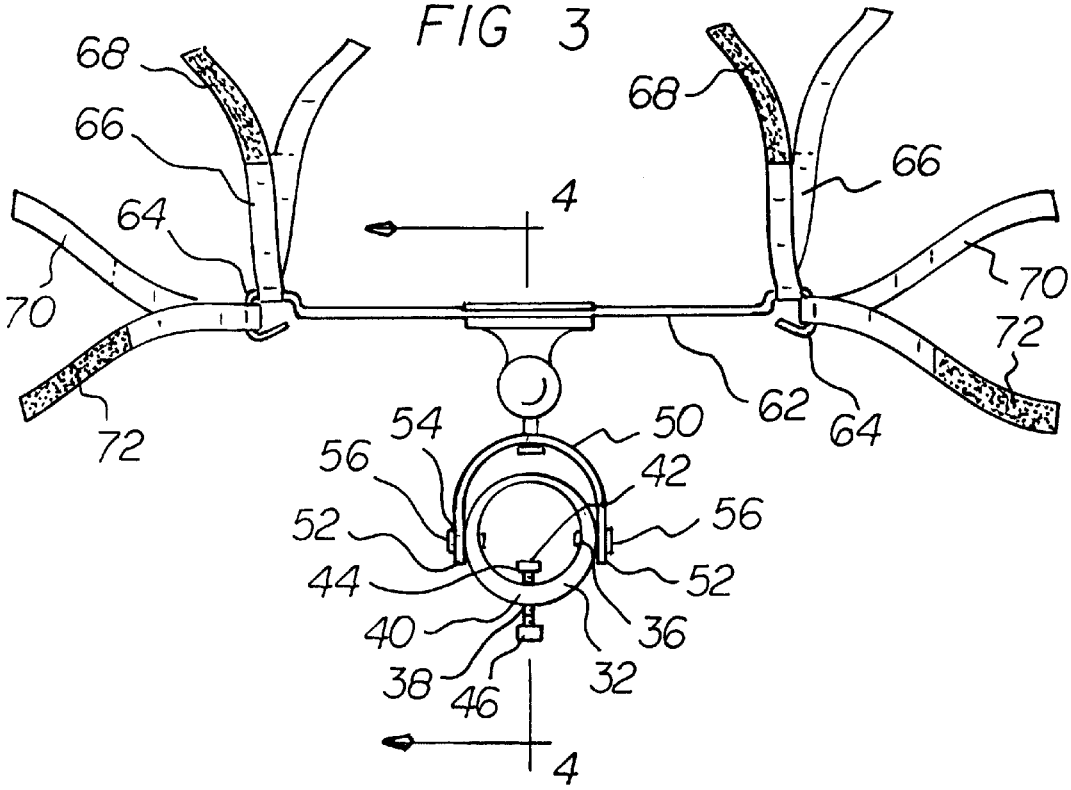
FIG. 3 is a front elevational view of the system taken along line 3—3 of FIG. 2.
Figure 4:
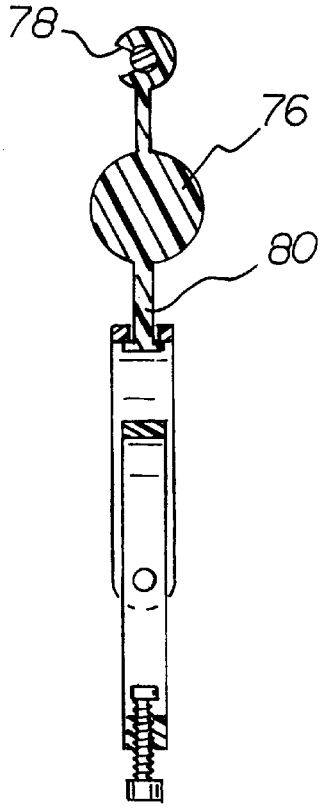
FIG. 4 is a cross-sectional view taken along line 4—4 of FIG. 3.

With reference now to the drawings, and in particular to FIG. 1 thereof, the preferred embodiment of the new and improved baby bottle holding system embodying the principles and concepts of the present invention and generally designated by the reference numeral 10 will be described.

The present invention, the baby bottle holding system 10 is comprised of a plurality of components. Such components in their broadest context include a baby bottle support, a generally horizontal member, and an intermediate adjustment member. Such components are individually configured and correlated with respect to each other so as to attain the desired objective.

An infant carrier 12 has an upper surface 14 for supporting a child. The carrier also has a lower surface 16 for positioning on a recipient surface. In association with such surfaces are lateral sides 18.

The carrier is manufactured to include an inverted U-shaped handle 20. The handle has opposed lateral legs 22 with free lower ends 24. Such free ends are pivotally secured to the sides of the infant carrier. The handle has a generally horizontal intermediate leg 26 coupling the lateral legs at locations remote from their lower ends. The free ends are joined to the sides of the carrier with mechanisms 28 to position the handle at any of a plurality of preselected angles for allowing the location of the baby bottle with respect to the child as will be understood from the description hereinafter. Mechanisms of such type are disclosed, for example, the U.S. Pat. No. 5,011,211 issued Apr. 30, 1991 to Wise, the subject matter of which is incorporated herein by reference. The carrier also includes straps 30 for retaining the child in a relatively fixed position on the upper surface.

Next provided is an enlarged support ring 32. The support ring has a central axis. The ring is of a size to receive and support a baby bottle 34 of any of a plurality of sizes and shapes. Lateral disposed apertures 36 are provided in the ring. A threaded aperture 38 is provided through an enlarged lower region 40 of the ring. A threaded bolt 42 is provided in the aperture. The bolt has an abutment surface 44 on its inner end adapted to contact and secure the baby bottle. The bolt is provided with a head 46 at its outer end. This arrangement allows for rotation of the bolt for securing and releasing the baby bottle within the ring.

The next component of the system is a downwardly facing semicircular saddle 50. The saddle is formed with lower free ends 52. The lower free ends are provided with apertures 54 aligned with the apertures of the support ring. Rivets 56 are also provided and extend through the aligned apertures of the saddle and ring to allow the rotational adjustment of the ring with respect to the saddle about an essentially horizontal axis. Such radial adjustment may be effected by the child or the child care provider. The saddle also has an uppermost extent 58 located centrally between the free ends.

A horizontally oriented rigid rod 62 is next provided. The rod has vertically oriented loops 64 formed at each end. A generally vertical strap 66 with a pile type fastener 68 at each end is secured to an upper extent of each loop. The strap is removably positioned around the ends of the intermediate leg of a handle. A generally horizontal strap 70 with a pile type fastener 72 is provided at each end and is secured to a lateral extent of each loop. The horizontal strap is removably positioned around the upper extents of the lateral legs of the handle. The straps are adapted to position the rod at a preselected elevation with respect to the upper surface of the infant carrier to provide adjustment capabilities to the supported bottle.

A block 76 is also provided. The block has a C-shaped horizontal recess 78 along its upper extent for being removably coupled with, and rotatably supported with respect to, the rod. The block has a lowermost extent 80 rotatably coupled through an aperture to the head bolt from the uppermost extent of the saddle. The central portion of the block is shown herein as a ball but could readily be formed as any object, decorative or otherwise.

Lastly provided is a baby bottle 84. The preferred baby bottle has a first axis over the majority of its extent removably positioned within the ring and axially coextensive with the axis of the ring. The baby bottle has a second axis over the minority of its extent terminating in a nipple 86 with a nipple ring 88. The end of the baby bottle remote from the nipple is adapted to rotate and contact the saddle. This arrangement functions to limit the angular movement of the baby bottle and support ring within the saddle.

As shown in the primary embodiment, the preferred bottle is a conventional baby bottle of a relatively long length. It is formed with a bend near the nipple end as described above. The portions of the bottle remote from the nipple acts as an abutment member to limit the pivoting motion of the bottle to maintain it away from the vertical. The bent portion adjacent to the nipple further provides the nipple at an appropriate angle for being conveniently held in the mouth of a child drinking from the bottle. It should be understood that conventional bottles without the bend may readily be utilized but a slight inconvenience is experienced by the child in that the angle of the nipple is further from the horizontal than when the bottle with the angle is utilized.

Figure 5:
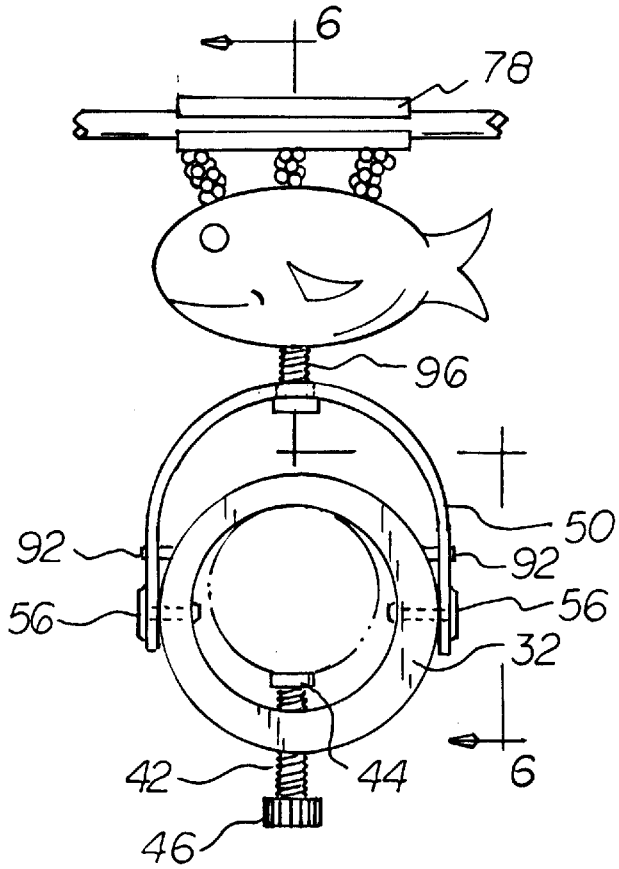
FIG. 5 is a front elevational view of an alternate embodiment of the invention.
Figure 6:
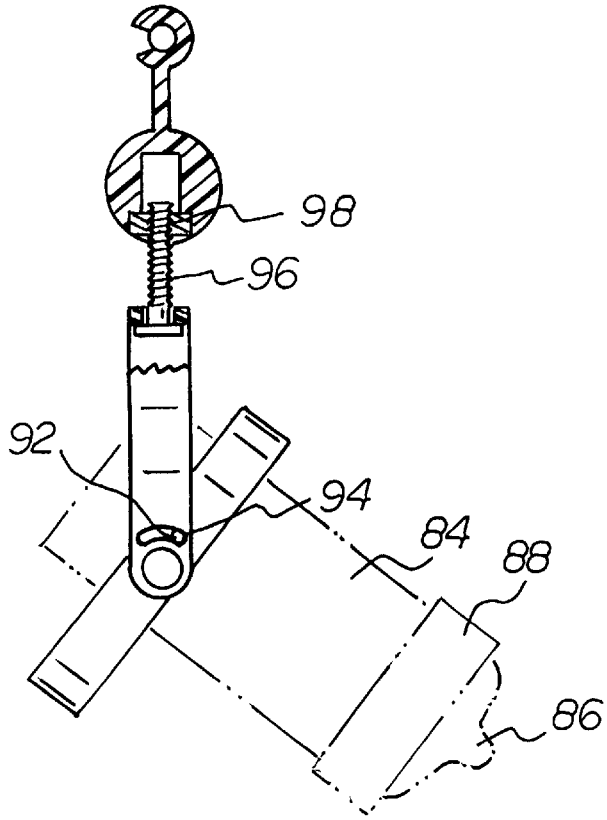
FIG. 6 is a cross-sectional view taken along line 6—6 of FIG. 5.

An alternate embodiment of the invention is shown in FIGS. 5 and 6 and may be utilized with bottles of an increasingly popular shorter length, the 4 ounce bottle size. When a short bottle is utilized, it is preferred to provide the support ring with lateral axial projections 92. Such projections are adapted to interact and contact an arcuate abutment surface 94 formed in the saddle. In this manner, the axis of the support ring and bottle is offset slightly from the vertical to assist in making the nipple at a more convenient angle for the child. This alternate embodiment with the stopped end abutment for short bottles is made even more convenient when the bottle is provided with a bend at the end thereof adjacent to the nipple.

A final feature of the alternate embodiment is in the area coupling the saddle and the block. In the primary embodiment such parts are rotatably secured with respect to each other. In the alternate embodiment additional vertical adjustments are provided by forming a bolt 96 extending upwardly from the central uppermost surface of the saddle with male threads extending downwardly from the upper end. In association therewith, the central lowermost region of the block is provided with mating female threads 98 for receiving the threads of the bolt. In this manner, the angular orientation of the saddle and support ring may be varied about the vertical axis of the bolt and the receiving threads. The receiving threads of the block may be formed directly into the bolt or, in the alternative, a separate insert positioned within a non-threaded recess of the block.

In the preferred embodiment of the invention, the support ring, saddle, and block are fabricated of a relatively rigid, non-toxic antiseptically treated material, such as a plastic, preferably polyvinylchloride (PVC). Other rigid materials, plastic or metal, could readily be utilized. The bolt of the primary embodiment as well as the bolt of the secondary embodiment including the thread insert for the block if utilized, are also preferably fabricated of a rigid material, preferably a plastic, preferably nylon for its lubricious capabilities as is frequently used for plastic threaded fasteners. In addition, the horizontal rod is also formed of a rigid material, such as metal, preferably stainless steel. The straps may be of any conventional fabric material, as for example, nylon.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus to adjustably retain a baby bottle in a position for ready access for drinking by a child, said apparatus comprising:

a baby bottle support for removably receiving a baby bottle in a position in proximity to a child for drinking, the baby bottle support being a support ring with a central axis adapted to be sized to receive and support a baby bottle therein, the ring having laterally disposed apertures there through with an enlarged lower region having a threaded aperture there through and with a threaded bolt therein with an abutment surface on its inner end adapted to contact and secure the baby bottle and a head at its outer end to allow rotation of the bolt for securing and releasing the baby bottle within the ring; and an intermediate adjustment assembly between the baby bottle support and the upper member under the control of the child and the child care provider to vary the position of the baby bottle with respect to the upper member.

2. The apparatus as set forth in claim 1 and further including a downwardly facing semicircular saddle with lower free ends formed with apertures aligned with the apertures of the support ring and with rivets extending through the aligned apertures of the saddle and ring to allow the rotation of the ring with respect to the saddle about an essentially horizontal axis, the saddle also having an uppermost extent located centrally between the free ends.

3. The apparatus as set forth in claim 2 and further including a projection functioning as a stopper extending axially from the support ring with an adjacent abutment surface on the saddle.

4. The apparatus as set forth in claim 1 wherein the intermediate adjustment assembly includes a block having a C-shaped horizontal recess along its upper extent for being removably coupled with respect to the rod and rotatable with respect thereto, the block having a lowermost extent coupled to the uppermost extent of the saddle.

5. The apparatus as set forth in claim 4 wherein the baby bottle support is fixedly secured to the intermediate adjustment assembly.

6. The apparatus as set forth in claim 4 wherein the baby bottle support includes an upwardly extending bolt with a threaded recess adjacent to the bottom of the intermediate support for the rotatable coupling therebetween.

7. A infant carrier system with adjustable baby bottle holding capabilities comprising, in combination:

an infant carrier having an upper surface for supporting a child and a lower surface for positioning on a recipient surface and with lateral sides, the carrier having an inverted U-shaped handle with opposed lateral legs and free lower ends pivotally secured to the sides of the infant carrier and a generally horizontal intermediate leg coupling the lateral legs remote from their lower ends, the free ends being joined to the sides of the carrier with mechanisms to position the handle at any of a plurality of preselected angles;

a support ring with a central axis therethrough sized to receive and support a baby bottle therein, the ring having laterally disposed apertures therethrough with an enlarged lower region having a threaded aperture therethrough and with a threaded bolt therein with an abutment surface on its inner end adapted to contact and secure the baby bottle and a head at its outer end to allow rotation of the bolt for securing and releasing the baby bottle within the ring;

a downwardly facing semicircular saddle with lower free ends formed with apertures aligned with the apertures of the support ring and with rivets extending through the aligned apertures of the saddle and ring to allow the rotation of the ring with respect to the saddle about an essentially horizontal axis, the saddle also having an uppermost extent located centrally between the free ends;

a horizontally oriented rigid rod with vertically oriented loops formed at each end, a generally vertical strap with a pile type fastener at each end secured to an upper extent of each loop and removably positioned around the ends of the intermediate leg of a handle and with a generally horizontal strap with a pile type fastener at each end secured to a lateral extent of each loop and removably positioned around the upper extents of the lateral legs of the handle, the straps adapted to position the rod at a preselected elevation with respect to the upper surface of the infant carrier;

a block having a C-shaped horizontal recess along its upper extent for being removably coupled with respect to the rod and rotatable with respect thereto, the block having a lowermost extent coupled to the uppermost extent of the saddle; and a baby bottle having a first axis over the majority of its extent removably positioned within the ring axially coextensive with the axis of the ring, the baby bottle having a second axis over the minority of its extent terminating in a nipple with a nipple ring, the end of the baby bottle remote from the nipple adapted to rotate and contact the saddle for functioning to limit the angular movement of the baby bottle and support ring within the saddle.

* * * * *